United States Patent [19]

Junker

[11] 4,020,741

[45] May 3, 1977

[54] FIREARMS

[76] Inventor: Ralph D. Junker, 33 N. Main St., Southampton, N.Y. 11968

[22] Filed: July 3, 1975

[21] Appl. No.: 592,721

Related U.S. Application Data

[62] Division of Ser. No. 487,239, July 10, 1974, Pat. No. 3,990,347, which is a division of Ser. No. 365,246, May 30, 1973, abandoned.

[52] U.S. Cl. ..... 89/185; 89/191 A; 89/14 C

[51] Int. Cl.[2] ..... F41D 5/02

[58] Field of Search ..... 89/185, 190, 191, 191 A, 89/192, 14 E, 14 C

[56] References Cited

UNITED STATES PATENTS

| | | | |
|---|---|---|---|
| 1,138,376 | 5/1915 | Hammond | 89/185 |
| 1,1 95,307 | 8/1916 | Wheatley | 89/190 |
| 1,355,378 | 10/1920 | Bardelli | 89/191 A X |
| 1,925,776 | 9/1933 | Scotti et al. | 89/185 X |
| 3,641,692 | 2/1972 | Wells | 89/185 UX |
| 3,772,123 | 3/1973 | Parisi | 42/18 X |

*Primary Examiner*—David H. Brown

*Attorney, Agent, or Firm*—Burns, Doane, Swecker & Mathis

[57] ABSTRACT

A firearm includes a housing having a detonation chamber and a projectile-discharge barrel. A displaceable piston is mounted at the discharge end of the barrel and is arranged to be acted upon and extended by combustion gases expelled from the barrel. Forward movement of the piston is transmitted to the housing in a manner tending to counteract recoil. The detonation chamber is arranged to receive a compression-responsive cartridge. A cartridge-detonating bolt is mounted within the bolt for reciprocal movement between cocked and discharge positions. A bolt-follower includes a locking device which is operable to temporarily lock the bolt against return movement to a cocked position while enabling the bolt to rotate. A cam-like configuration of the working end of the bolt compresses the cartridge in response to rotation of the bolt. The bolt-follower is coupled to the displaceable piston such that detonation-induced forward movement of the piston shifts the bolt-follower to an unlocking position. Actuating linkage is provided for transmitting bolt movement to the loading mechanisms of the firearm.

4 Claims, 7 Drawing Figures

FIREARMS

RELATED INVENTIONS

This is a division of U.S. application Ser. No. 487,239 filed July 10, 1974 and now U.S. Pat. No. 3,990,347, issued Nov. 9, 1976, the latter being a division of U.S. application Ser. No. 365,246 filed May 30, 1973 and now abandoned.

BACKGROUND AND OBJECTS OF THE INVENTION

This invention relates to firearms, and is especially suited to firearms of the automatically-operating type.

The recognition of firearms as a practicable form of weapon marked the advent of a search for a firearm exhibiting optimum efficiency and effectiveness. Despite the continued improvements being made in this field, there are numerous problems which have persisted and still plague the designers to this day.

Ranking high among these problems is, for example, recoil which occurs upon firing. That is, detonation of a charge within the firearm produces a forward propelling thrust on the projectile and a rearward force, or recoil, which must be withstood by the shooter. Efforts have been made to counter the effects of recoil. Exemplary of such attempts is the Green U.S. Pat. No. 2,128,243, issued Aug. 30, 1938. In this proposal, gases expelled from the barrel are to be directed against inclined baffle surfaces affixed to the muzzle end of the firearm. It is intended that these gases should impart a forward thrust to the baffle, and thus to the firearm as a whole, in an effort to counteract detonation recoil. Whatever advantages such a baffle might produce, the magnitude of the forward anti-recoil forces which can be produced thereby is limited due to the inclined nature of the baffle surfaces. Furthermore, these inclined surfaces deflect the combustion gases from the firearm in an almost radial direction relative to the barrel bore. During automatic, rapid-fire operation of a firearm, such a gas discharge can obscure the shooter's vision and possibly cause him physical discomfort.

Another persistant problem concerns firearms of the automatic-type in which various operations, such as ejection, re-loading, and re-cocking, must be automatically mechanically accomplished preparatory to firing a succeeding round. It has been suggested to direct a portion of the combustion gases from the barrel to a chamber to reciprocate a piston reciprocally mounted therein. The piston would be suitably coupled to perform at least some of these operations. The Scotti U.S. Pat. No. 1,925,776, issued Sept. 5, 1933, is exemplary of such a proposal. An inherent problem associated with the use of an enclosed, gas-actuated piston is the necessity of maintaining the gas-conducting lines and the piston chamber free of gas residues which might obstruct proper functioning of the mechanism.

Other significant problems associated with firearms, particularly automatic firearms, relate to the use of ammunition rounds which comprise an assemblage of a projectile, a charge of propellent, and a non-consumable casing carrying both components. It is necessary to orient each round in a special posture and actuate both an obturation bolt and a firing pin in proper sequence before detonation can occur. Ejection of the spent casing is necessitated to accomodate insertion of a new cartridge. Moreover, in an automatic firearm, these operations must occur rapidly, thereby necessitating expensive, complicated, and rather "temperamental" mechanisms. Proposals have been made in an attempt to alleviate some of these problems, one proposal involving the use of rounds which are caseless. Even in such an instance the propellant and projectile components of the round are intended to be connected in tandem and thus will still be of a size requiring that the loading mechanism be shifted a sufficient distance to accomodate insertion of a new round. This requires the transmittal of significant amounts of energy and limits the cyclic rate of operation of the firearm.

A very serious proposal in this area has recently been made by the present inventor in U.S. Pat. No. 3,641,867, issued Feb. 15, 1973. This proposal involves a unique concept wherein the projectile and the propellent are independent and separate. The propellent is in the form of a combustible pellet-like cartridge which is compressed and detonated within a detonation chamber by a reciprocal bolt. The detonation chamber communicates with a bore carrying the projectile such that combustion gases are effectively exerted against the projectile. An effective form of cartridge which is especially suited for use in such a firearm is disclosed and described in the inventor's pending U.S. application Ser. No. 324,669, filed Jan. 18, 1973, and having matured into U.S. Pat. No. 3,828,676, issued Aug. 13, 1974. The proposals introduced by the inventor constitute significant strides in the evolution of an ideal firearm in that they feature the elimination of an ejection stage, reduction of recoil, the use of less expensive ammunition, and an increase in the cyclic rate of operation, among other advantages. Not withstanding such advancements, there remains further room for improvement in optimizing the over-all performance of firearms.

It is therefore, a general object of the invention to provide a novel firearm which obviates or minimizes problems of the sort previously noted.

It is another general object of the invention to provide a firearm which presents minimum physical irritation and interference to a shooter.

It is particular object of the present invention to provide a novel firearm which minimizes recoil effects.

It is another object of the invention to provide a novel firearm which simplifies the detonation stage.

It is yet another object of the invention to provide an automatic firearm which facilitates the performance of the loading, obturating, firing, and cocking stages.

Still another object of the invention is to provide an automatic firearm in which gas-residue build-ups are minimized.

BRIEF SUMMARY OF A PREFFERED EMBODIMENT

A preferred form of the invention intended to accomplish at least some of the foregoing objects entails a firearm having a barrel, a detonation chamber communicating with a barrel, and a firing mechanism for igniting a charge and propelling a projectile through the barrel.

At the discharge end of the barrel a piston is displaceably mounted. The piston includes a reaction surface positioned to be contacted and driven forwardly by combustion gases from the barrel. The reaction surface is preferably disposed substantially perpendicular to the path of travel of the projectile. Connecting linkage between the piston and barrel is provided to convert forward displacement of the piston into a recoil-countering thrust on the firearm.

The firearm features a detonation chamber which is arranged to receive a caseless cartridge of propellent independently of the projectile. A detonating bolt is reciprocally mounted for movement within the detonation chamber between cocked and detonating positions. The bolt also includes a working face for compressing the cartridge against a wall of the discharge chamber to ignite the cartridge. A lug projects from the bolt and is guidingly received in a slot formed in the firearm housing. The slot includes a helical extension which is arranged to receive the lug and induce rotation of the bolt. A bolt-follower is disposed adjacent one end of the bolt and is arranged to lock the bolt against return to a cocked position while still permitting rotational movement of the bolt toward a detonating position.

The bolt-follower is coupled to the displaceable piston such that forward displacement of the piston shifts the bolt-follower to and unlocking position, thereby permitting residual gases within the detonation chamber to drive the bolt back to its cocked position.

The working face of the bolt is configured in a manner for producing compressive forces on a cartridge in response to rotation of the bolt during its detonation stroke.

Linkage is provided so that movement of the bolt during a detonation stroke is transmitted to a cartridge feed control mechanism to effectuate automatic cartridge insertion.

THE DRAWINGS

Other objects and advantages of the present invention will become apparent from the subsequent detailed description thereof in connection with the accompanying drawings in which like numerals designate like elements, and in which.

DETAILED DESCRIPTION OF A PREFERRED EMBODIMENT

Figure 1:
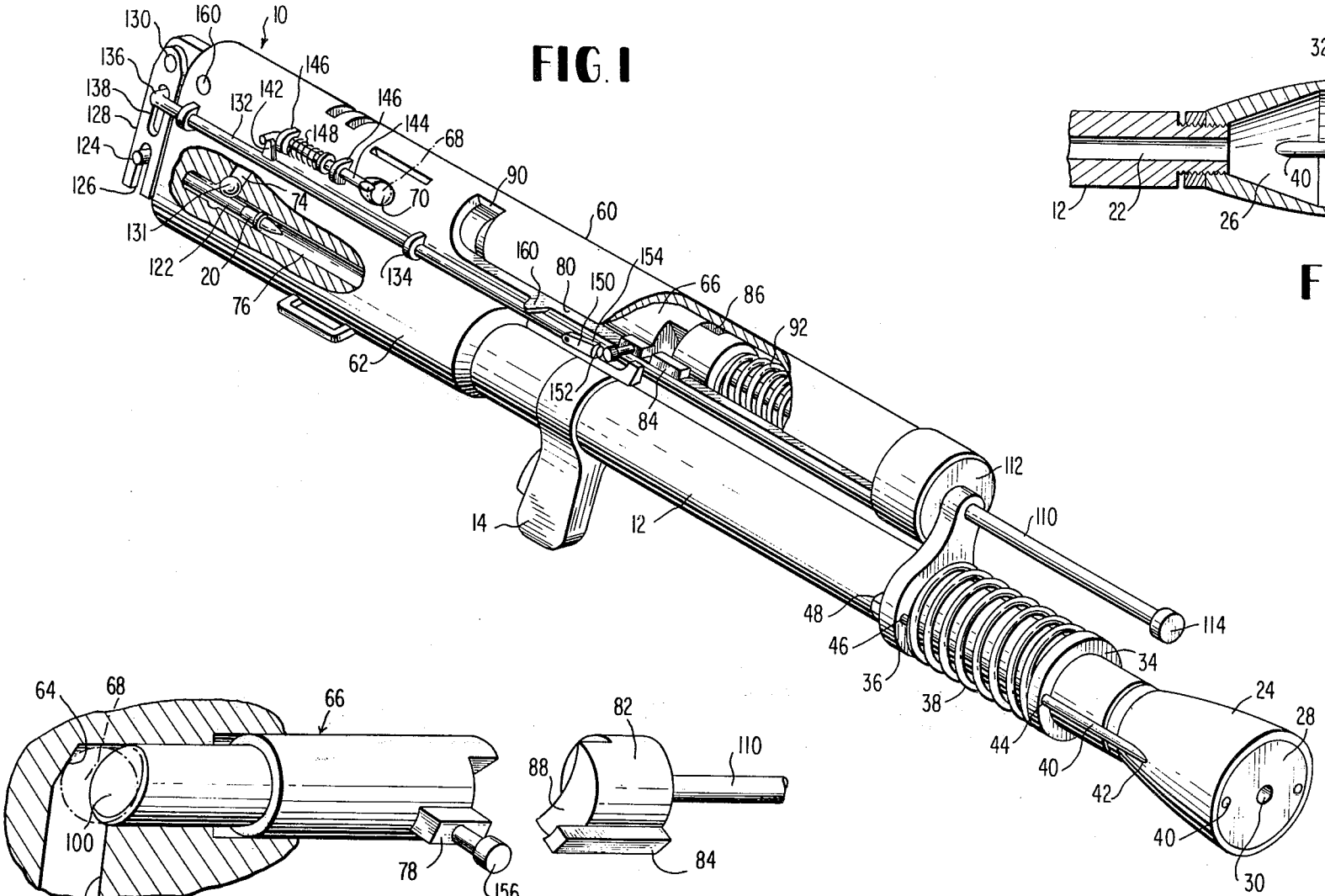
FIG. 1 is a perspective view, with portions broken away, of a portion of a firearm in its cocked position, in accordance with the present invention.

A portion of an automatic firearm in accordance with the present invention is illustrated in FIG. 1 and includes a main housing 10 which includes a barrel 12 and a gripping handle 14. A suitable triggering mechanism (not illustrated) may be mounted to the housing 10 for actuating a sear element (not illustrated) as will be subsequently discussed. As will also be subsequently described in more detail, the main housing has a detonating chamber in which propellant is detonated to propel a projectile 20 through the central bore 22 of the barrel 12.

Anti-Recoil Mechanism

Figure 7:
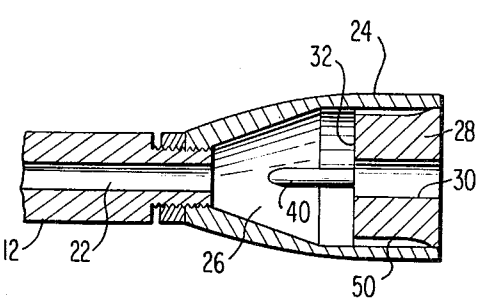
FIG. 7 shows a front portion of the firearm, in a longitudinal section, depicting a recoil-countering mechanism in accordance with the present invention.

At its discharge end, the barrel 12 has a muzzle element 24. This muzzle element may be threadedly attached to the barrel, although any suitable form of connection may be utilized. The muzzle element 24 defines an inner chamber 26. Disposed with the chamber 26 is a piston 28. The piston is mounted for sliding displacement within the chamber between a withdrawn position (FIGS. 1, 2 and 7), and an extended position (FIGS. 3). The piston includes a central aperture 30 which is aligned with, and preferably larger than, the central bore 22 of the barrel. At its rearward end the piston defines a reaction surface 32 which is disposed generally perpendicular to the axis of the bore 22 (FIG. 7). This reaction surface is arranged to be contacted by combustion gases which are expelled from the barrel 12. In response thereto, the piston is driven outwardly toward its extended position.

Fixedly attached to barrel 12 behind the muzzle element 24 is a ring 34. Rearwardly of the ring 34 a collar 36 is slidably mounted on the barrel. Disposed intermediate the collar 36 and the ring 34 is a coil compression spring 38. Interconnecting the piston 28 with the collar 36 are a pair of rods 40. These rods are secured to the piston 28 and project rearwardly, extending slidably through apertures 42, 44, and 46 in the muzzle 24, the ring 34, and the collar 36, respectively. Nuts 48 are threadedly received at the ends of the rods 40 and function to transmit forward movement of the piston 28 to the collar 36.

Disposed around the outer periphery of the piston 28 are a plurality of gas-vent slots 50 (FIG. 3). These slots 50 at their rearward ends, communicate with the inner chamber 26 of the muzzle and terminate at their forward ends short of the front end of the piston.

Figure 2:
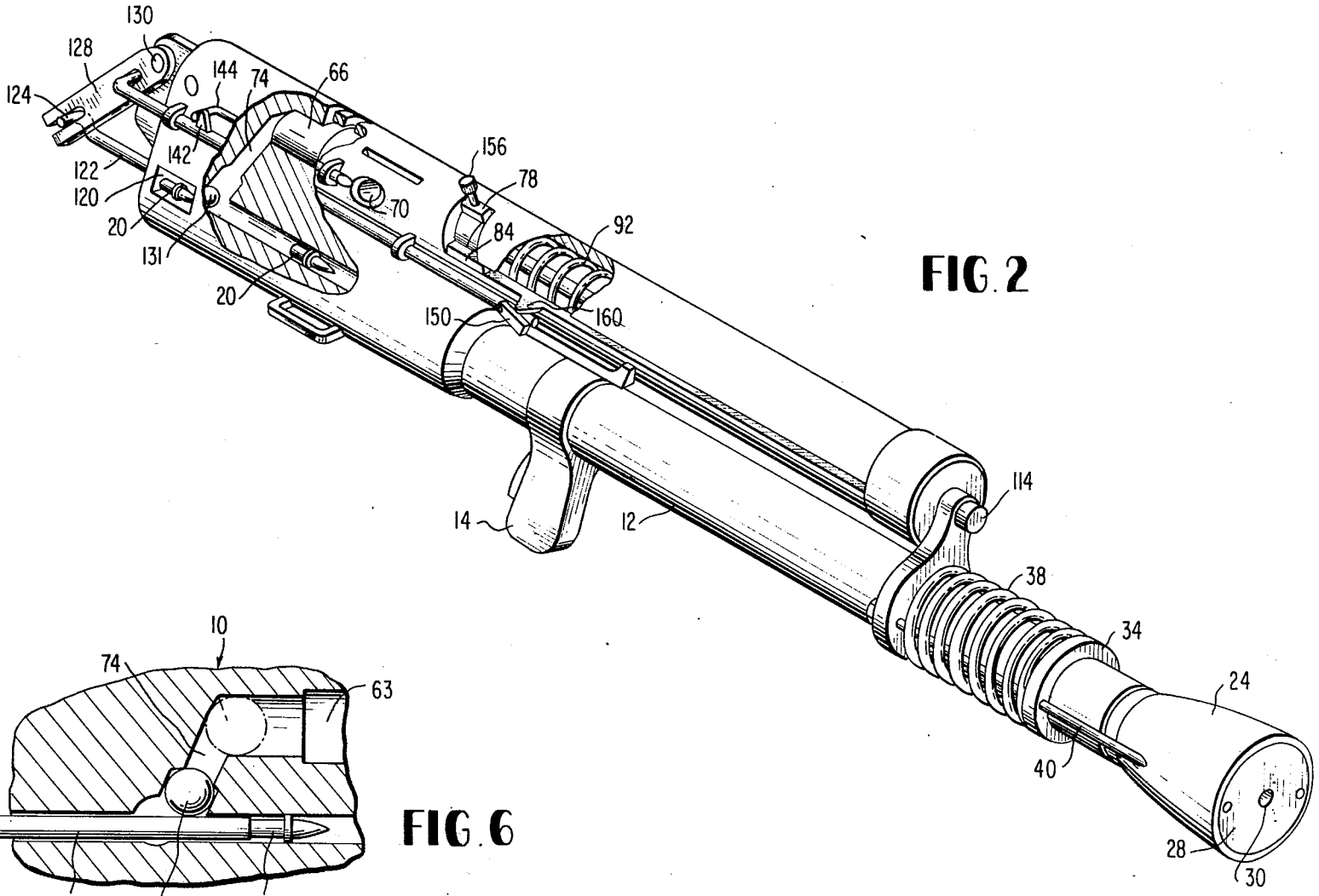
FIG. 2 is a perspective view, with portions removed illustrating the firearm in a projectile-firing stage of operation.
Figures 3, 5:
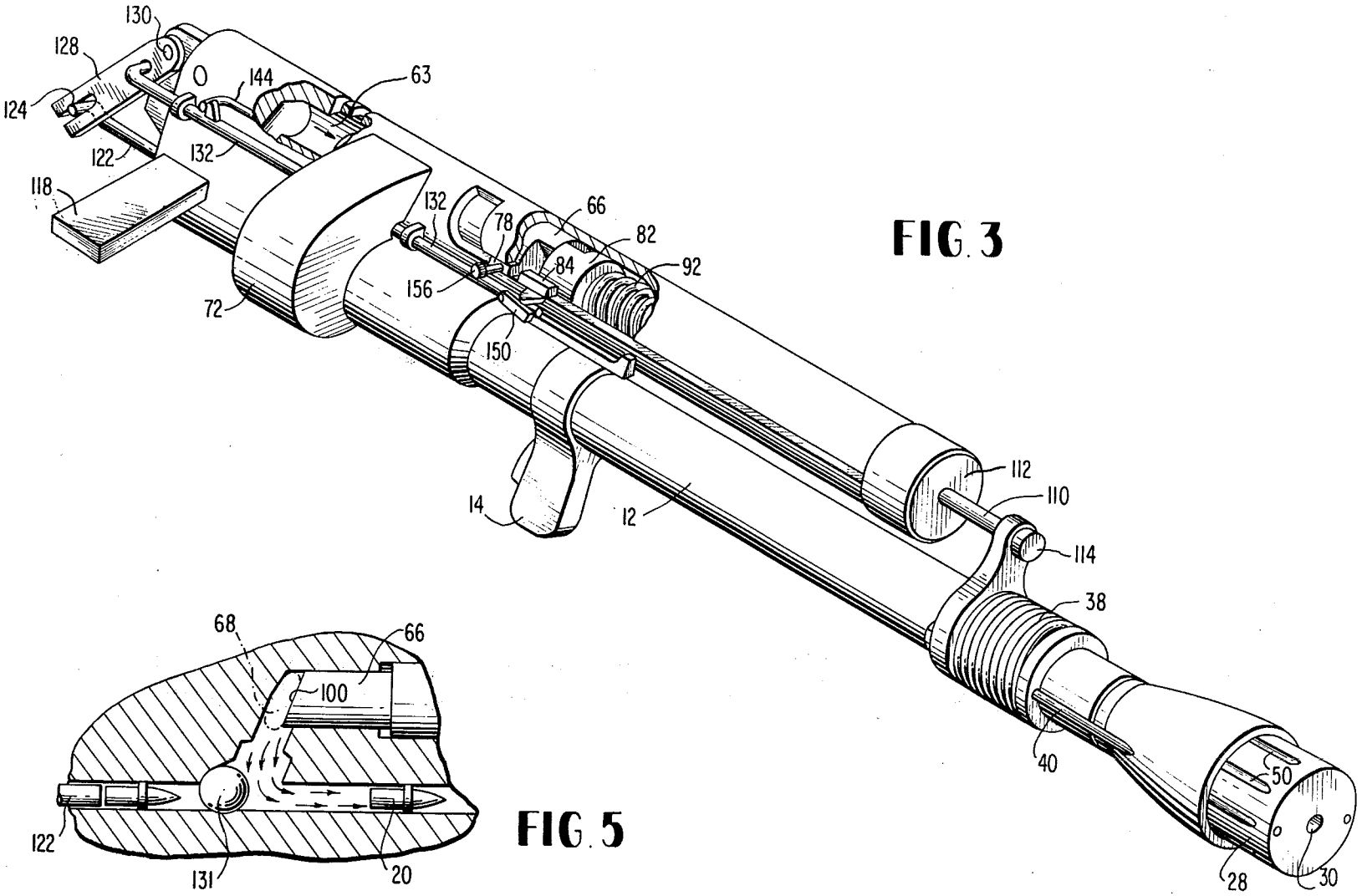
FIG. 3 is a perspective view, with portions removed, illustrating the firearm in a post-firing condition.
FIG. 5 is a schematic illustration of the detonating mechanism in a cartridge-detonating condition.

Prior to cartridge detonation, the piston is in a withdrawn position, as shown in FIGS. 1 and 2. When detonation occurs a projectile is fired through the barrel. The projectile passes through the aperture 30 of the muzzle 24. Combustion gases are discharged from the bore 12 behind the projectile and impact against the reaction surface 32, thereby driving the piston 28 forwardly.

Forward movement of the piston will be transmitted to the barrel through the rods 40, the collar 36, the spring 38, and the ring 34. In this fashion, energy of the combustion gases is utilized to produce a forward force or thrust on the barrel in a manner tending to counter the usual recoil forces produced by detonation. These counter-forces will be applied rapidly and progressively as the spring 38 is compressed.

Significantly, after the piston has been driven forwardly a predetermined distance, the forward ends of the vent slots 50 communicate the muzzle chamber 26 with ambient surroundings. Combustion gases still within the chamber will thus be exhausted through the slots. The front ends of the slots are configured so as to direct the exhausted gases in a generally forwardly direction (FIG. 7).

It will be apparent that in accordance with the principles of the invention, any suitable mechanism may be provided in lieu of that discussed, to convert forward movement of a displaceable piston into a recoil-countering impulse on the firearm. Such mechanism need not be connected directly to the barrel, but may be connected to other parts of the firearm. The gas-vent slots 50 could, if desired, be located in the inner surface of the muzzle chamber 26 to direct spent gases substantially forwardly. It should be apparent that the rapid passage of combustion gases through the slots, as provided by the invention, produces a generally self-cleaning action on the slots and resists residue build-up within the muzzle element chamber.

Firing Mechanism

Figure 4:
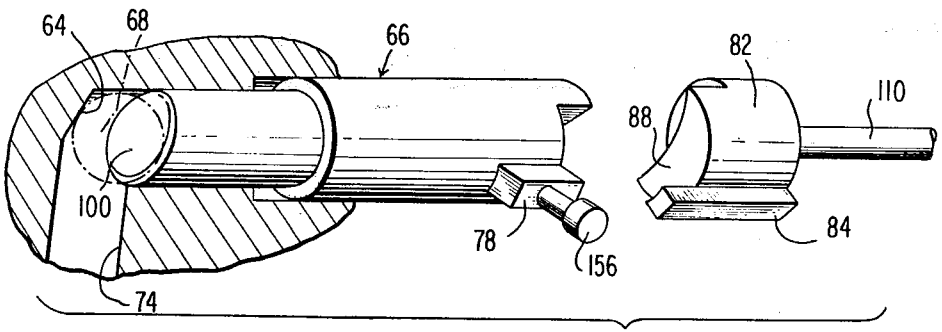
FIG. 4 is an exploded view, in perspective, of a cartridge-detonating mechanism in accordance with the invention.

The main housing 10 includes a hollow jacket 60 and a hollow casing 62 arranged therebelow. The detonating chamber 63 is located at the inner end of the jacket 60 and is defined in part by an inner end wall 64. Situated within the jacket 60 is a detonating bolt 66 which is reciprocal from a forward, cocked position (FIG. 1) to a rearward, detonating position (FIGS. 2 and 4).

The bolt 66 is arranged to compress and detonate a pellet-like, pressure-sensitive cartridge 68. The cartridges disclosed in the afore-mentioned U.S. Pat. No. 3,641,867 and Application Ser. No. 324,669 are exemplary of acceptable types of cartridges. The disclosures of this patent and application are incorporated herein by reference.

A cartridge 68 may be inserted into the firing chamber through a cartridge feed opening 70 in the jacket. In an automatic firearm, a plurality of cartridges 68 may be carried within a magazine 72 detachably mounted to the housing 10 (FIG. 3).

A passage 74 communicates the detonation chamber 73 with a central bore 76 of the casing 62. Although the passage 74 is shown as being generally rearwardly inclined, it could be vertically or forwardly inclined in accordance with the invention. The casing bore 76 is aligned with the barrel bore 22. Combustion gases from the detonation chamber will be expelled through the passage 74 and into the casing bore 76 to propel, through the barrel, a projectile 20 which is situated in the casing bore ahead of the passage 74.

In order to assure that substantially all of the combustion gases will be diverted through the passage 74 for maximum utilization of power, the bolt 66 is provided with a locking arrangement which prevents forward movement of the bolt for a predetermined interval after detonation. The locking arrangement includes a lug 78 affixed to and projecting outwardly from an outer surface of the bolt. This lug 78 is reciprocally guided within a slot 80 formed in the jacket 60.

Situated ahead of the bolt 66 is a bolt-follower 82. The bolt-follower is provided with an outwardly-projecting locking boss 84 which is guidingly received in the slot 80. The bolt and bolt-follower include proximate abutment faces 86 and 88 which are normally in a mutually abutting condition. These faces are, however, arranged to be shifted out of mutual alignment in response to a predetermined rotation of the bolt 66.

Such rotation of the bolt 66 is produced by travel of the bolt lug 78 within a helical extension 90 of the slot 80. Such rotation also produces a slight rearward displacement of the bolt 66 toward the wall 64.

Disposed between the front end of the bolt-follower 82 and a front end wall of the jacket 60 is a coil compression spring 92. This spring 92 is arranged to bias the bolt-follower 82 toward the bolt 66 and provide the requisite energy for driving the bolt against a cartridge 68 in a detonation stage of the firing cycle. The bolt and bolt-follower are held in a cocked position, with the spring compressed, by a sear element (not shown) which is suitably actuated by a trigger mechanism. The sear functions to selectively hold and release the bolt as will be readily understood by one skilled in the art.

Release of the bolt 66 enables the spring 92 to drive the bolt and bolt-follower rearwardly, such movement constituting a detonation stroke. When the bolt lug 78 enters the helical extension 90 during the final portion of the detonation stroke, the abutment face 86 of the bolt rotates out of alignment with the abutment face 88 of the bolt-follower 82. Consequently, the cam-follower is shifted rearwardly relative to the bolt, under the urging of the spring 92. In this fashion, the locking boss 84 assumes a position overlying the inlet to the helical extension 90 to prevent the lug 78 from rotating outwardly from the confines of the extension. The locking boss itself is a sufficient length to prevent its entry into the helical extension.

The proximate ends of the bolt 66 and the bolt-follower 82 are configured to enable the bolt to rotate relative to the bolt-follower even following the relative movement of the bolt-follower into its locking position.

Thus, the bolt may continue rotating to complete the detonation stroke, even after the lug 78 has become locked within the helical extension 90. However, return of the bolt to a cocked position is prevented by the locking boss 84 being disposed across the extension 90. In this fashion, when detonation occurs, the energy produced by combustion will not be immediately dissipated in shifting the bolt forwardly. Consequently, substantially all of the combustion forces will be expended to propel the projectile.

At the instant that the bolt lug 78 enters the extension 90, the cartridge 68 may be slightly compressed, but will not be subject to compression sufficient to cause ignition. This occurs only after the bolt has rotated enough to accomodate entry of the bolt-follower to its locking position.

The rearward working end of the bolt 66 is configured to assure that the bolt 66 imparts sufficient compressive forces to detonate the cartridge 68 after locking occurs. As shown in FIG. 4, the working end surface 100 of the bolt 66 is configured to define a cam face which is operable to displace the cartridge rearwardly 68 as the bolt rotates. Thus, at the point where the bolt begins to rotate, the cartridge is situated within a pocket defined by the walls of the detonation chamber and the working face 100 of the bolt. This pocket may be slightly smaller than the cartridge to cause slight compression, without detonation, of the cartridge. As the bolt rotates, the bolt shifts slightly rearwardly due to the helical nature of the slot extension 90, to increase compression of the cartridge. More importantly, however, there is a simultaneous shift in the orientation of the cam-like working face relative to the walls of the detonation chamber in a manner which progressively reduces the size of the pocket. Thus, in response to slight rotation of the bolt, the compressive forces exerted on the cartridge are significantly increased to produce detonation. The working face and detonation chamber may, of course, assume any desired shape suitable for increasing compression in response to bolt rotation.

Once detonation has occurred and the projectile has been discharged from the firearm, the bolt 66 is unlocked and returned to a cocked position. This can be accomplished, in non-automatic firearms, by any suitably arranged manually-actuable mechanism coupled to the bolt and bolt-follower.

Preferably, however, in accordance with the present invention, unlocking and re-cocking is accomplished automatically. Accordingly, the bolt-follower 82 is operably coupled to the piston 28. One suitable form of connection comprises a rod 110 which is attached to the bolt-follower 82 and extends slidably through a forward end wall 112 of the jacket 60. The rod is slidably received in an opening in the sliding collar 36. A knob 114 on the forward end of the rod 110 provides a driving connection between the collar 36 and the rod 110 during forward movements of the collar.

When the bolt 66 is at the end of its detonation stroke, the knob 114 abuts the sliding collar 36 as shown in FIG. 2. Subsequent forward movement of the piston 28 and collar 36 under the influence of discharging gas pressure, slides the rod 110 and the bolt-follower 82 forwardly. When the locking boss 84 is shifted free of the helical extension 90, residual gas pressure in the discharge chamber 63 is able to urge the bolt forwardly to its cocked position.

Loading Mechanism

Although its is within the scope of the present invention that the cartridge and projectile may be loaded manually, its is preferable that the loading operation be automated. Therefore, in addition to the cartridge magazine 72, a projectile magazine 118 may be attachable to the casing 62 to feed projectiles 20 through a feed slot 120 in the casing (FIGS. 2 and 3). Projectiles 20 are individually fed laterally into the rearward end of the casing bore 76 and are then rammed into a firing position ahead of the passage 74 by a plunger 122 (FIG. 1) by means to be subsequently described. Once in position, the projectile is maintained in place by frictional contact with the bore 76.

Figure 6:
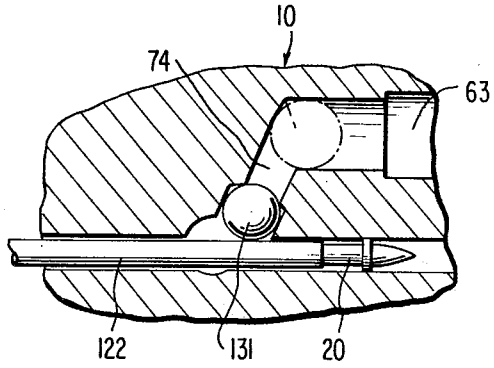
FIG. 6 is a schematic illustration of the detonating mechanism in a pre-detonating condition.

The plunger 122 has a bent rear end portion 124 mounted in a groove 126 carried by a link 128. This link 128 is pivoted at 130 to the housing 10. Pivotal movement of the link 128 produces a rectilinear reciprocation of the plunger 122 within the casing bore 76. During forward movement of the plunger 122, a projectile which has been inserted through the feed slot 120 will be rammed forwardly, as shown in FIG. 6. A ball valve 131 is shiftably mounted at the junction of the passage 74 and the casing bore 76. This valve 131, with the plunger retracted, seats across the bore 76 behind the projectile to block rearward escape of combustion gases (FIG. 5). The ball 131 is, however, free to shift upwardly when the plunger 122 rams a projectile forwardly (FIG. 6).

An actuation rod 132 is reciprocally mounted within ears 134 carried by the housing 10. A bent rear end portion 136 of the actuation rod 136 is received within a slot 138 of the link 128. At a rear portion of the rod 132, a rigid lip 142 extends upwardly.

Situated within the path of travel of the lip 142 is a bent-end portion of a gate arm 144. This gate arm 144 is reciprocally mounted in ears 146 carried by the housing 10. A spring 148 is disposed to urge the front end of the gate arm 144 to a position overlying the cartridge feed opening 70 to block insertion of cartridges through the opening 70 as shown in FIG. 1.

At its front end the rod 132 carries a finger 150 which is pivoted to the actuating rod 132 for up-and-down swinging movement. A suitable spring (not shown) biases the finger 150 to an upward posture (FIG. 1).

The finger 150 includes an upstanding front face 152 and an inclined top face 154. The front face 152 is arranged to be contacted and urged rearwardly by a pin 156 which projects outwardly from the bolt lug 78. This urging occurs during the initial stages of the detonation stroke to shift the gate arm 144 to an unblocking posture (FIG. 2) allowing entry of a cartridge 68 into the detonation chamber in the path of the rearwardly traveling bolt 66. Simulataneously, the link 128 is swung in a manner causing retraction of the plunger 122 to a position behind the ball valve 131 (FIG. 5).

When the rod 132 has been slid sufficiently to open the gate arm and retract the plunger, the inclined face 154 of the finger 150 is engaged and depressed by a tab 160 which projects outwardly from the housing 10. This disengages the finger 150 from contact with the pin 156 and halts rearward travel of rod 132. The spring 148, which biases the gate arm to its closed posture, acts now on the lip 142 to urge the rod 132 forwardly.

The above-discussed actuating mechanism is arranged to assure that loading and plunger retraction occur prior to the instant when the bolt reaches the cartridge inlet opening 70, and that subsequent plunger extension is delayed until after detonation occurs.

It should be noted at this point that although the connection between the housing 10 and a conventional stock is not shown, suitable connections will be apparent to one skilled in the art. One form of connection may comprise a pivotal connection wherein the housing is coupled to the stock for swinging movement relative thereto about a pivot 160 at the end of the housing. In this fashion, access to the rear portion of the housing may be conveniently obtained.

OPERATION

At the initiation of a firing cycle, the components of the firearm are disposed in a cocked, pre-firing condition as shown in FIG. 1. Thus, a projectile 20 is frictionally held in the casing bore 78 ahead of the passage 74. The plunger 122 is situated immediately therebehind (FIG. 6) to block the projectile insert slot 120.

Within the discharge chamber 63, the bolt 66 is held in a forward cocked position by a sear (not shown), with the spring 92 being disposed in a compressed state. The gate arm 144 overlies the cartridge feed opening 70 to restrain entry therethrough of a cartridge 68.

At the discharge end of the firearm, the piston 28 is held in a retracted position within the muzzle element 24 by the spring 38.

Upon suitable actuation of the triggering mechanism (not shown), the sear releases the bolt 66 for a detonation stroke toward the rearward end of the detonation chamber 63, under the influence of the spring 92. Spring forces are transmitted to the bolt through the bolt-follower 84, via abutment surfaces 86 and 88.

During initial stages of rearward bolt travel, the pin 156 contacts the front face 152 of the finger 154 to drive the actuating rod 132 rearwardly. In this fashion, the lip 142 shifts the gate arm 144 rearwardly to admit a cartridge 68 into the detonation chamber in the path of the rearwardly traveling bolt 66. Simultaneously, the actuating rod 132 pivots the link 128 to withdraw the plunger 122 to a retracted position, thereby allowing the ball valve 131 to assume an obturation posture within its valve seat (FIG. 5).

As the bolt 66 continues its detonation stroke, it drives the cartridge 68 against the rear section 64 of the detonation chamber (FIG. 4). Prior to detonation, however, the bolt lug 78 enters the helical slot extension 90 thereby imparting rotation to the bolt 66. As a result of this rotation, the working face 100 of the bolt is both translated rearwardly, and rotated into an orientation which cooperates with the chamber wall portions to compress the cartridge to yet a greater degree, sufficient to cause detonation.

Prior to the occurence of detonation, the lug 78 will have rotated within the helical extension 90 by an amount sufficient to bring the abutment surfaces 86 and 88 out of alignment. Consequently, the bolt-follower 82 is shifted rearwardly, relative to the bolt 66, as the bolt 66 continues to rotate. This enables the locking boss 84 to assume a position overlying the inlet to the helical extension 90, as shown in FIG. 2. Thus, by the time that sufficient detonating compression of the cartridge 68 has occurred the, bolt is rendered temporarily unable to return to a cocked position.

When detonation occurs, the forces of combustion are directed through the passage 74 and against the back end of the projectile 20. With the bolt 66 being locked, and the ball valve 131 blocking the rear end of the bore 76, a substantial part of the combustion energy is expended in discharging the projectile.

When the projectile 20 leaves the discharge end of the barrel bore 22, it passes through the central aperture 30 in the piston 28. Combustion gases exiting from the barrel behind the projectile engage the reaction surface 32 of the piston and drive the piston forwardly. This forward movement of the piston 28 is transmitted to the barrel 12 through the rods 40, the collar 36, the spring 38, and the ring 34 to exert a forward thrust on the barrel. Such a forward thrust tends to counteract the recoil forces occurring in response to detonation. Due to the spring-biased arrangement of the collar 36, the recoil-countering forces from the piston 28 are imparted generally smoothly to the barrel as the collar progressively compresses the spring 38.

During its forward movement, the collar 36 pulls the rod 110 forwardly to withdraw the bolt-follower and locking boss 84 from the bolt-locking position. Residual gas pressure within the detonating chamber 63 acting against the bolt 66 is then able to drive the bolt forwardly to a cocked position. If the trigger mechanism remains depressed at this point, the spring 92 will immediately return the bolt toward the rear end of the discharge chamber in a subsequent detonation stroke to repeat the firing cycle.

Subsequent to detonation, but prior to the initiation of a succeeding firing cycle the actuating rod 132 is returned to its forward position by the spring 148 after the finger 154 is depressed by the tab 160. In so doing, the gate arm 144 returns to a blocking position relative to the cartridge fee inlet 70, and the plunger 122 rams another projectile 20 into the casing bore 76 ahead of the passage 74.

SUMMARY OF MAJOR ADVANTAGES AND SCOPE OF THE INVENTION

In accordance with the invention, a recoil-countering piston is displaceably mounted at the discharge end of the firearm. The reaction surface of the piston is arranged generally perpendicular to the path of travel of the projectile, thereby enabling substantial portion of the energy of the exhaust gases to be converted into a recoil-resisting thrust. The spring arranged between the piston and barrel tends to transmit the recoil-countering forces in a generally smooth manner to avoid undue shocks to the firearm and shooter. Gas-vent slots formed in the piston enable gases to be vented to atmosphere in a manner minimizing obstruction and annoyance to the shooter. The slots are self-cleaning and tend to avoid residue build-ups within the muzzle chamber.

The unique locking arrangement of the bolt and bolt-follower enables the bolt to continue compressing the charge even after locking has occurred. In this fashion, there is no need for separate bolt and firing pin elements. Moreover, compression of a cartridge in response to bolt rotation is afforded by the cam-like arrangement of the working surface of the bolt to facilitate detonation.

The unique interconnection between the bolt-follower and the displaceable piston enables the bolt to be unlocked as recoil forces are being countered.

Further efficiency and simplicity of operation is afforded by the arrangement wherein an actuating rod is driven by movement of the bolt to effect loading of the firearm.

Although the present invention has been described in connection with a preferred form thereof, it will be appreciated by those skilled in the art that additions, modifications, substitutions, and deletions not specifically described may be made without departing from the spirit of the scope of the invention as defined in the appended claims.

What is claimed is:

1. In a firearm comprising barrel means, a charge detonation chamber, bolt means shiftable relative to said chamber, means for locking said bolt means against movement away from a charge disposed in said chamber during firing of a projectile, and means for automatically unlocking said bolt subsequent to firing, said unlocking means comprising:

displaceable means mounted adjacent a discharge end of said barrel means for displacement relative thereto;

said displaceable means including reaction surface means positioned to be acted upon, and displaced, by combustion gases from said barrel means to produce forward displacement of said displaceable means;

means connecting said displaceable means and said barrel means to transmit recoil-resisting forces from said displaceable means to said barrel means in response to said forward displacement of said displacement means; and means connecting said displaceable means with said locking means to shift said locking means to a position unlocking said bolt means in response to firing said firearm.

2. Apparatus according to claim 1 wherein said locking means includes a movable stop; said displaceable means comprises a piston slidably mounted in a muzzle end of said barrel means; said piston having a central aperture for discharging a projectile; said connecting means comprising a rod connected to said displaceable means and to said locking means.

3. In a firearm including housing means having a charge-detonating chamber for receiving a compressably ignitable charge, projectile discharge means communicating with said chamber and being arranged to receive a projectile which is independent of said charge; bolt means displaceably mounted in said chamber for movement between a cocked position and a charge-detonation position; force-storing means arranged to urge said bolt means toward said detonation position during a detonation stroke; locking means disposed between said force storing means and said bolt means to prevent return of said bolt means to said cocked position while permitting continued movement of said bolt means to complete said detonation stroke; means for shifting said locking means to an unlocking position subsequent to discharge of said projectile to permit return of said bolt means to said cocked position; displaceable means mounted adjacent the discharge end of the said discharge means for forward displacement relative thereto; said displaceable means having reaction surface means positioned to be contacted and driven forwardly by combustion gases from said discharge means; and means for transmitting energy from said displaceable means in a manner tending to resist recoil forces; said shifting means being connected to said displaceable means for automatically shifting said locking means to its unlocking position in response to forward movement of said displaceable means.

4. In a firearm comprising barrel means, a charge detonation chamber, bolt means shiftable relative to said chamber, movable locking means including a stop for locking said bolt means against movement away from a charge disposed in said chamber during firing of a projectile, and means for automatically unlocking said bolt subsequent to firing, said unlocking means comprising:

displaceable means mounted adjacent a discharge end of said barrel means for displacement relative thereto, said displaceable means including:

reaction surface means positioned to be acted upon, and displaced, by combustion gases from said barrel means; and a piston slidably mounted in a muzzle end of said barrel means, said piston having a central aperture for discharging a projectile; and means connecting said displaceable means with said locking means to shift said locking means to a position unlocking said bolt means in response to firing said firearm;

said connecting means comprising a rod connected to said displaceable means and to said locking means.

* * * * *